US005686721A

United States Patent [19]

Schmidt-Bocking

[11] Patent Number: 5,686,721

[45] Date of Patent: Nov. 11, 1997

[54] POSITION-TRANSMITTING ELECTROMAGNETIC QUANTA AND PARTICLE RADIATION DETECTOR

[75] Inventor: Horst Schmidt-Bocking, Kelkheim, Germany

[73] Assignees: Litef GmbH; Roentdek-Handels GmbH, both of Germany

[21] Appl. No.: 517,774

[22] Filed: Aug. 22, 1995

[51] Int. Cl.[6] ..... H01J 40/14

[52] U.S. Cl. ..... 250/214 VT; 313/103 R

[58] Field of Search ..... 250/207, 214 VT; 313/528, 532, 534, 536, 540, 103 R, 103 CM, 105 R, 105 CM

[56] References Cited

U.S. PATENT DOCUMENTS

| | | | |
|---|---|---|---|
| 4,395,636 | 7/1983 | Anger et al. . | |
| 4,703,168 | 10/1987 | Olson | 250/207 |
| 5,493,111 | 2/1996 | Wheeler et al. | 250/207 |

FOREIGN PATENT DOCUMENTS

| | | |
|---|---|---|
| 3704716 | 9/1990 | Germany . |
| 3638893 | 4/1991 | Germany . |
| 4310622 | 10/1993 | Germany . |
| 2237142 | 4/1991 | United Kingdom . |

OTHER PUBLICATIONS

Article, J. S. Lapington, A. A. Breeveld, M. L. Edgar, J. A. Tandy, and N. W. Trow, "SPAN—A Novel High Speed High Resolution Position Readout", *Optical and Optoelectronic Applied Science and Engineering* (Jul. 1990).

Article, J. S. Lapington, A. A. Breeveld, M. L. Edgar, and M. W. Trow, "A novel imaging readout with improved speed and resolution", *Second London PSD Conference* (Sep. 1990).

*Primary Examiner*—Edward P. Westin
*Assistant Examiner*—John R. Lee
*Attorney, Agent, or Firm*—Elliott N. Kramsky

[57] ABSTRACT

A method and apparatus for image signal decoupling in position-transmitting high-vacuum electromagnetic radiation quanta or particle detectors. The electromagnetic radiation quanta or particles impinge on a spatially resolving anode structure through a photoelectron converter layer (in the case of electromagnetic radiation) and directly through an electron multiplier as an electron avalanche (in the case of particle radiation). The electron avalanche is first collected for a short time inside the vacuum on the anode side by means of a high-resistance, conducting semiconductor thin film, and is then read out capacitively from the outside through the glass bottom (counter-substrate) of the detector device as an image charge by means of a low-resistance anode layer of suitable structure. The capacitive decoupling permits high spatial resolution when the internal resistances of the charge collecting layer and the readout anode layer are optimally adapted to one another. The decoupling requires only a simple high-resistance monolayer in the vacuum with a single voltage contact. The spatially resolving anode structure outside the vacuum can be modified or exchanged to individually adapt the spatial resolution.

14 Claims, 3 Drawing Sheets

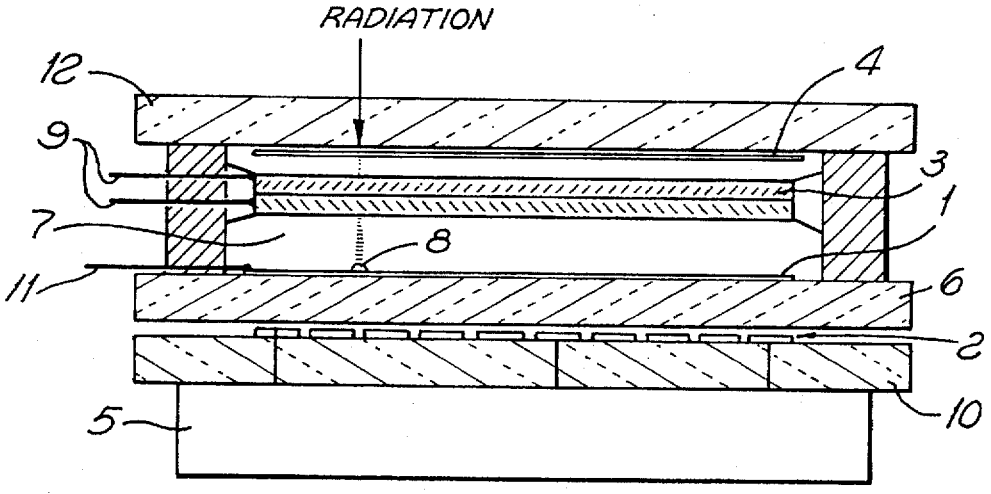
FIG. 1
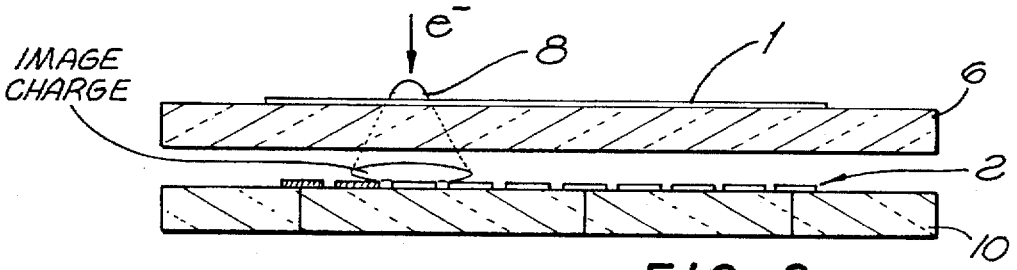
FIG. 2
FIG. 3
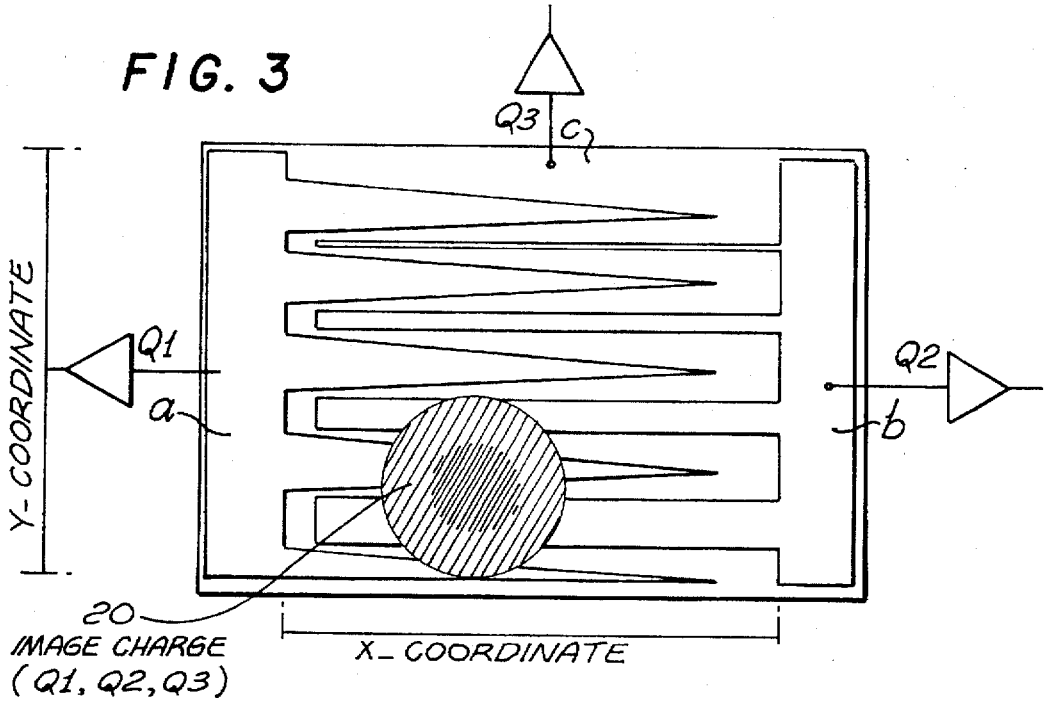

SHADOW IMAGE OF THE 0.2mm WIRES.

POSITION-TRANSMITTING ELECTROMAGNETIC QUANTA AND PARTICLE RADIATION DETECTOR

BACKGROUND

1. Field of the Invention

The present invention relates to position-transmitting high-vacuum detector devices for quanta or particle radiation. More particularly this invention pertains to image signal decoupling in such devices.

2. Description of the Prior Art

Position-transmitting electronic detector systems are required in many applications to detect individual UV or other electromagnetic radiation quanta, particles or the like. Multi-channel electron multipliers, which must be installed in special high-vacuum glass bodies, depending on the application, are required for detecting individual radiation quanta with such detector systems.

FIG. 5 is a side elevation view in cross-section of a position-transmitting electromagnetic radiation quanta or particle radiation detector in accordance with the prior art. Two-dimensional locating or positioning of the photon detection requires the installation in a conventional system, such as that illustrated in FIG. 5, of complex, resistive anode structures 1 having, for example, four contacts in a high vacuum 7 that lead to the outside. These render possible digital spatial resolution of the radiation detection. Production of the detector, which requires assembly and mounting the complex anode structure 1 with the wire bushings within the evacuated glass body 6 for the high-frequency signals required not only poses great technical difficulties, but also makes it impossible to later adapt the anode structure 1 optionally to a different measurement task. The individual detector components form a unit incapable of separation or modification by conventional methods and detector devices.

The known detector system of FIG. 5 includes an electron converter layer 4 (UV quanta electron converter layer), applied to the inner side of a radiation-transparent cover substrate 10, a chevron plate system 3 as charge multiplier that possesses high-voltage lead wires 9, which are led out, as well as the resistive anode structure 1 applied to the vacuum-side inner surface of the counter substrate 11 in addition to the evacuated glass body 6, and the layer-shaped, resistive anode structure 1 having a downstream electronic system with connections 13 for each of four preamplifiers, for example. A local charge avalanche generated by a UV quantum on the anode structure 1 is indicated at 8.

SUMMARY AND OBJECTS OF THE INVENTION

It is therefore an object of the invention to provide substantially simpler and more reliable electronic positioning (i.e. position-referred image signal decoupling) without direct electrical contacts through the vacuum partition wall in a detector device of the type described above for quanta or particle radiation.

It is a further object to achieve the above object in a device capable of adaptation to changed measurement tasks.

In the method for image signal decoupling in position-transmitting high-vacuum detectors for quanta or particle radiation that impinges on a spatially resolving anode structure through an electron multiplier device as an electron avalanche, the electron avalance remains spatially collected for a short time inside the vacuum on the anode side of the detector device by means of a high-resistance, conducting thin film, and the collected charge is read out capacitively, coupled through a vacuum wall, as an image charge by means of a low-resistance anode layer which is arranged opposite the high-resistance thin film outside the vacuum and is structured in a fashion suitable for locating.

In contrast, in prior-art radiation quanta detector devices, the spatially resolving anode structure is arranged interior to the high vacuum with a plurality of vacuum-tight bushings for high-frequency signals for the downstream electronic system without allowing the subsequent possibility of adjustment or adaptation to different measurement tasks. The invention is based on the concept of collecting the, charge avalanches, induced by the radiation quanta, in a short-term spatially bound fashion on the inner surface, opposite the radiation entrance, of the counter-substrate through a continuously uniform high-resistance conducting layer and then coupling them capacitively through the vacuum wall (substrate layer) on to a low-resistance, structured anode layer outside the vacuum.

A position-transmitting electromagnetic radiation or particle radiation detector, in which, inside a high-vacuum space bounded by a planar substrate spaced therefrom, there are (following one another in a layer-like fashion) on the radiation incidence side, a plate-type electron multiplier arrangement and planar anode. The detector is characterized according to the invention in that, for the purpose of capacitive, position-referred image signal readout, a high-resistance charge collecting layer is present on the vacuum-side inner surface of the counter-substrate and a low-resistance anode layer, structured in a fashion suitable for locating, is opposite and on the outer surface of the counter-substrate (i.e., outside the vacuum).

Unlike conventional detectors for electromagnetic radiation quanta or particle radiation, the invention permits the use of comparatively simple, uniform detector elements or modules whose electronic position readout can be matched individually and in an optimized fashion to different measurement tasks by different structuring of the low-resistance anode layer situated outside the vacuum. A further essential advantage resides in that no electrical bushings are required in the vacuum for high-frequency current pulses. Furthermore, it is possible to produce the electronic system for amplification and digitization in conjunction with the low-resistance anode structure as a highly integrated circuit (for example using SMD technology, as a hybrid or as ASIC).

It is advantageous for the low-resistance, structured anode layer to be designed, for example, in the form of a so-called wedge and strip anode. The charge-collecting regions or busbars for read out are arranged at right angles to one another in a manner proportional to the image charge at at least two, and preferably three, edges of the anode layer. However, it is also possible to employ other, arbitrary, suitable structures such as, for example, a Vernier anode, a spiral structure, a delay line layer or a pixel system that is digitally read out by a CCD. Furthermore, it is necessary, or at least expedient, to select the internal resistances of the charge-collecting layer and the capacitively coupled outer anode layer and the downstream electronic system for optimizing spatial resolution, while taking the dielectric provided by the counter-substrate layer into account.

It is expedient to allow the sensitive area of the outer, low-resistance anode layer to project over the image edges of the vacuum-side charge collecting layer to avoid image errors at the edge region of the detector.

The features and advantages of this invention will become further apparent from the detailed description that follows.

Such written description is accompanied by a set of drawing figures. Numerals of the drawing figures, corresponding to those of the written description, point to the features of the invention. Like numerals refer to like features throughout both the written description and the drawing figures.

BRIEF DESCRIPTION OF THE DRAWINGS

FIG. 1 is a side elevation view in cross-section of a detector including a position-transmitting readout of electromagnetic quanta or particle radiation in accordance with the invention;

FIG. 2 is a partial view illustrating a section of the counter-substrate of the detector of FIG. 1;

FIG. 3 is a top plan view of the detector illustrating a portion of a wedge and strip anode of the type that may be employed for position-transmitting image signal decoupling in accordance with the invention;

DETAILED DESCRIPTION OF THE PREFERRED EMBODIMENT

Figure 5:
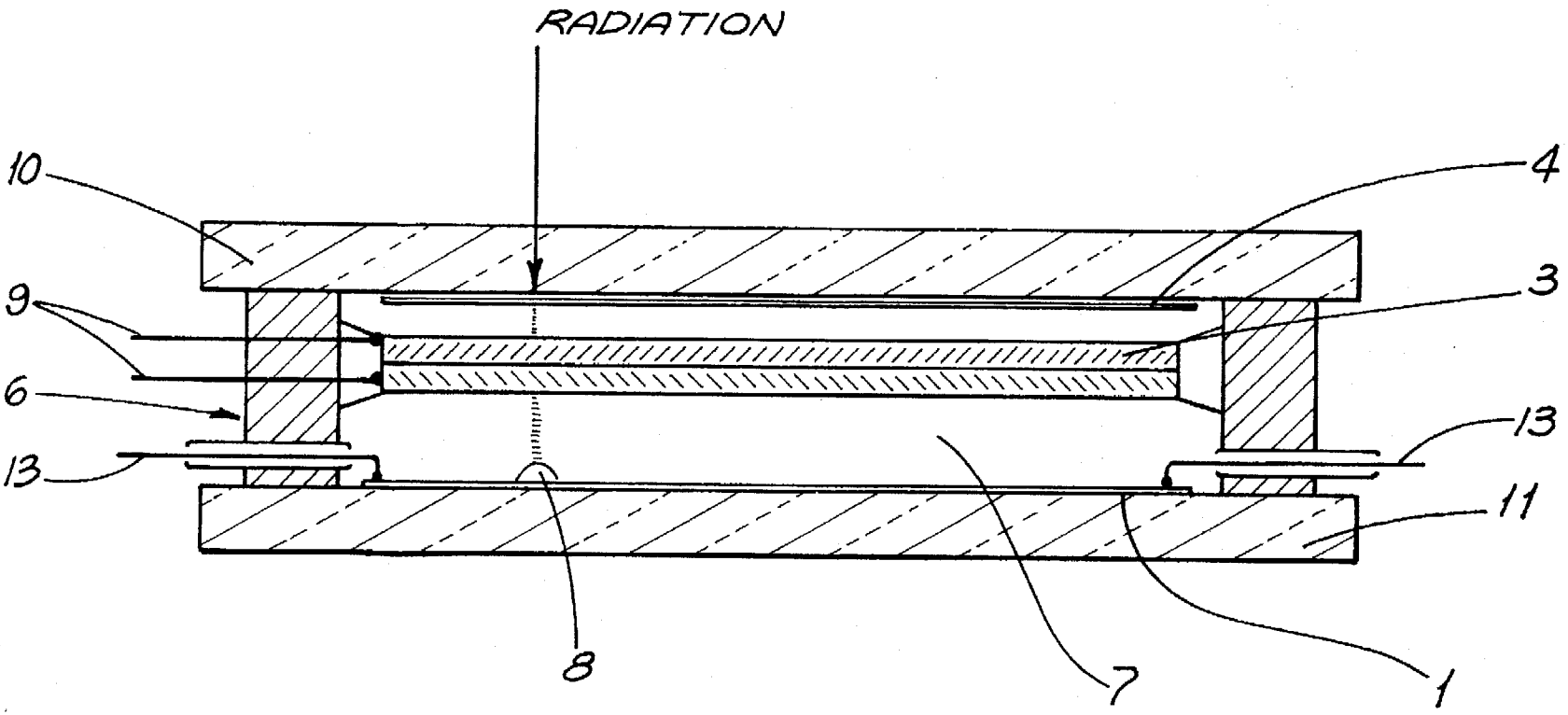
FIG. 5 (PRIOR ART)
FIG. 5 is a side elevation view in cross-section of a position-transmitting electromagnetic radiation quanta or particle radiation detector in accordance with the prior art.

FIG. 1 is a side elevation view in cross-section of a detector including a position-transmitting readout of electromagnetic quanta or particle radiation in accordance with the invention. The image-intensifier system, including the photoelectron converter layer 4, the chevron plate system 3 (of an underlying multichannel electron multiplier) and the high-resistance anode layer 1 according to the invention is installed within a high vacuum 7 as in the prior art. (Note: elements corresponding to the prior art detector of FIG. 5 are indicated by identical numerals in FIG. 1.) In contrast to the prior art, the complex anode structure 2 for electronic position readout is arranged outside the vacuum 7 on the rear of the detector. For example, the structure 2 may be applied to the rear of the counter-substrate 6. The transmission of precise positional information relating to an incident radiation quantum (UV quantum) or particle is performed capacitively after appropriate charge multiplication (in 3) by the counter-substrate 6 (preferably of glass) of the image intensifier system on to the low-resistance anode structure 2 that is outside the vacuum 7. Capacitive transmission is made possible as the charge collecting layer formed on the inner side of the base- or counter-substrate 6 (i.e., within the vacuum) is applied as a high-resistance (anode) layer on which the electron avalanche 8 induced by a single radiation quantum or particle is collected and remains there a few 10 ns due to the assumed high layer resistance (megohm range) illustrated below (FIG. 2).

The local charge avalanche 8 capacitively couples through the glass layer of the counter-substrate 6 to generate an image charge on or in the opposed low-resistance anode structure 2. The low-resistance anode structure 2 may, for example, be a wedge-and-strip anode having three contact regions (denoted a, b, and c in FIG. 3, below). The structure of such anode may be adapted in a comparatively simple way to attain the necessary positional resolution. The structure 2 is, in that case, located on the outer side of the counter-substrate 6 (i.e. at ambient atmospheric pressure). The precise position of the image charge can then be determined by appropriately designed and arranged quick charge-sensitive preamplifiers and an evaluation logic system (not illustrated), the design of which is understood by those skilled in the art.

Capacitive decoupling makes high spatial resolution possible when the internal resistances of the anode layers 1 and 2 are optimally matched to one another and the anode structure 2 is geometrically structured for high resolution. In addition to the wedge-and-strip anode described, for example, in publications co-authored by J. S. Lapington, A. A. Breeveld, M. L. Edgar and M. W. Trow ("Span—A Novel High Speed High Resolution Position Readout", *Optical and Optoelectronic Applied Science and Engineering* (July 1990) and "A Novel Imaging Readout With Improved Speed and Resolution", *Second London PSD Conference* (September 1990)), other spatially resolving anode structures are also contemplated within the scope of the invention. Such anode structures include, for example, a Vernier anode, a spiral anode, a delay-line layer and a pixel system with digital readout by CCD.

The operation of capacitively position-referred signal decoupling for digital position readout may be described briefly with reference to FIG. 2, a partial view illustrating a section of the counter-substrate of the detector of FIG. 1. The local charge cloud 8 generated in the chevron plate 3 within the vacuum 7 impinges on the high-resistance anode layer 1 of, for example, Ge of a few 100 nm thickness, and remains there for a few 10 ns. During this time, an image charge is built up, by capacitive coupling, on the other side of the counter-substrate 6 on the low-resistance anode structure situated outside the vacuum 7. Depending on the geometry of this low-resistance anode structure 2 (e.g., a three-part wedge strip anode, as in FIG. 3), each position is uniquely determined by a specific image charge ratio. For a low-resistance anode structure, the image charge distribution may be determined by fast electronic components. It is alternatively possible to employ the ratios of the image charges Q1, Q2 and Q3 to determine precisely the position X, Y in the image plane by utilizing the following relations:

$$\frac{X}{XO} = \frac{Q1}{Q1+Q2+Q3}$$

$$\frac{Y}{YO} = \frac{Q2}{Q1+Q2+Q3}$$

An image charge cloud is indicated by a shaded region 20 on FIG. 3, a top plan view of the detector illustrating a portion of a wedge and strip anode that may be employed for position-transmitting image signal decoupling in accordance with the invention. Such a region 20 forms on the anode structure 2.

A detector according to the invention may detect individual events with a very high position-referred temporal resolution. In the case of detectors currently under testing, spatial resolution approximates 1/250 of detector width or, given the uses of suitable lens systems, 0.5°.

Figure 4A:
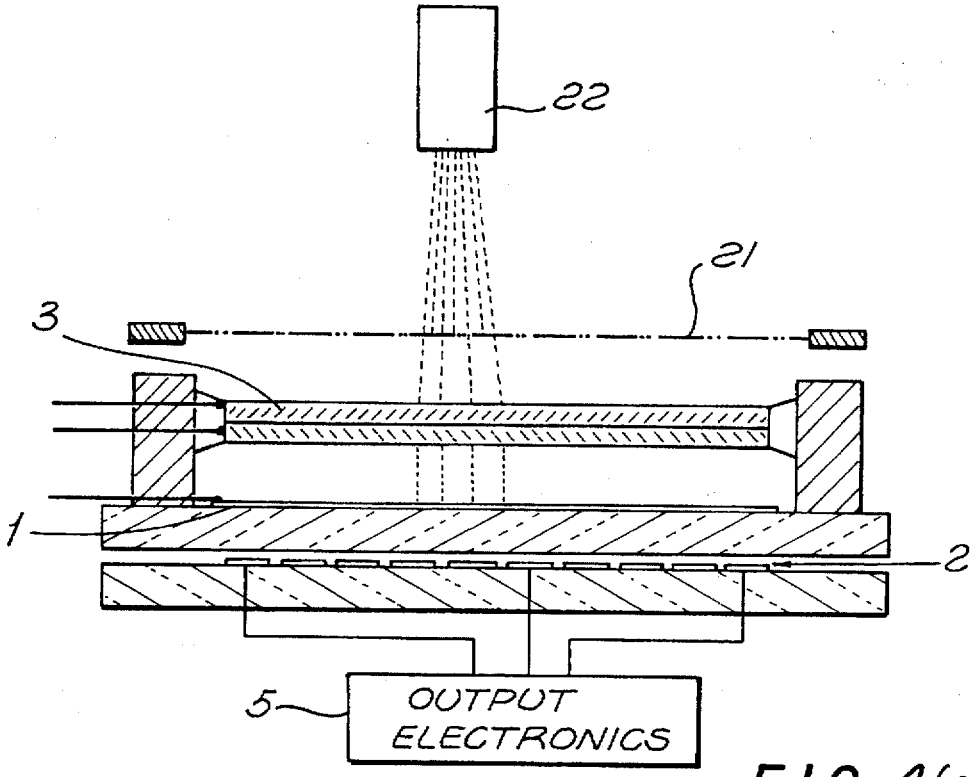
FIGS. 4(*a*) and 4(*b*) illustrate an experimental setup including a detector in accordance with the invention employing a capacitively coupled, position-transmitting anode structure and exemplary measurement data obtained therefrom, respectively.
Figure 4B:
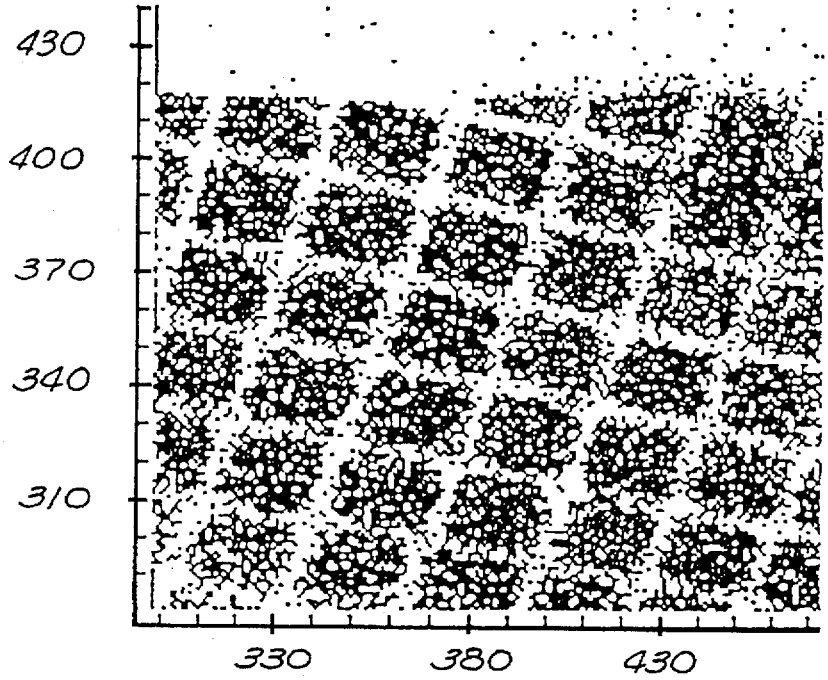

FIG. 4(*a*) illustrates an experimental setup including a detector in accordance with the invention that employs a capacitively-coupled position-transmitting structure while FIG. 4(*b*) illustrates an exemplary radiation positional determination measurement data. A radioactive preparation radiating alpha particles was employed as a radiation source 22. The radiation-transparent cover substrate and the photoelectron converter layer were removed as the alpha particles may release electrons directly at the entrance into the chevron plate 3. A shadow mask 21 of 0.2 mm thick wires, whose image was to be electronically detected, was mounted between the radiation source 22 and the chevron plate 33.

The graph of FIG. 4(*b*) illustrates the resultant shadow image of the wires of the shadow mask 3 (tensioned at right angles to one another) picked up by the wedge and strip structure of the low-resistance anode 2 and the downstream electronic system. The resolving power determined by these measurements was less than 0.2 mm as a function of the anode structure selected.

The advantages of the invention may be summarized as follows:

1. Image signal decoupling according to the invention requires only a simple high-resistance monolayer having a single penetrating voltage contact in the vacuum. Bushings are not required for high-frequency current pulses, leading to substantial simplification of production of the vacuum component.

2. In contrast to conventional detectors of this type, only a moderate voltage (e.g. 200 volts) is required between the channel or chevron plate 3 and the high-resistance anode layer 1. This permits the detector to be operated in a simpler and more reliable manner. Consequently, the dark discharge rate of the detector is markedly reduced and destruction of the anode structure by voltage flashovers in the detector is virtually excluded.

3. The spatially resolving, low-resistance anode structure 2 is arranged outside the vacuum 7 and, in accordance with the user's wishes, may be almost arbitrarily adapted and exchanged. As a result, individual adaptation of locating precision to each user problem is possible over a wide range of relative spatial resolution (1 to 0.1%).

4. The electronic system 5 for amplification and digitization can be mounted, using modern SMD or hybrid technology, onto the anode structure 2 directly and in an integrated manner outside the vacuum. This produces substantially improved resolution and clear simplification of the electronic system with corresponding cost savings. The spatially resolving, low-resistance anode structure 2 can be applied either to a separate plate or directly onto the outer side of the vacuum partition walls of the counter-substrate 6.

5. The anode structure 2 can be mounted outside the vacuum 7 with a larger sensitive area than the chevron or channel plate 3 image errors at the image edge can thereby be avoided.

The invention has been described with reference to its presently-preferred embodiment. However, the scope of this invention is limited only insofar as it is defined by the following set of patent claims and includes within its scope all equivalents thereof.

What is claimed is:

1. A method for electronic, contactless image signal decoupling in a position-transmitting high-vacuum electromagnetic quanta or particle radiation detector of the type in which incoming radiation, after incidence upon an electron multiplier device, impinges as an electron avalanche upon a spatially-resolving anode structure, said method comprising the steps of:

(a) collecting said electron avalanche for a short time within a vacuum on the anode side of said detector by means of a high-resistance conducting thin film; and then (b) capacitively reading said collected electron avalanche charge out as an image charge with a low-resistance anode layer arranged opposite said high-resistance thin film outside said vacuum.

2. In a position-transmitting detector for electromagnetic radiation or particle radiation of the type in which, inside a high-vacuum space bounded by a planar, radiation-transparent cover substrate at a radiation incident side of the detector and a counter-substrate spaced therefrom, there are, following one another in a layer-like fashion on the radiation-incident side, a plate-type electron multiplier arrangement and a planar anode spaced therefrom, the improvement comprising said anode being a high-resistance charge collecting layer located on the vacuum-side inner surface of said counter-substrate for receiving an electron avalanche, and, opposite therefrom on the outer surface of the counter-substrate, there is a low-resistance anode layer for capacitive, position-referred image signal readout of said electron avalanche as image charge.

3. A detector as defined in claim 2, further characterized in that:

(a) said vacuum-side, high-resistance charge collecting layer comprises a uniformly planar monolayer on said counter-substrate; and (b) a high-voltage potential may be applied to it from outside by means of a vacuum-tight bushing.

4. A detector as defined in claim 3 wherein said charge collecting layer comprises a high-resistance semiconductor layer.

5. A detector as defined in claim 4 wherein said charge collecting layer comprises a germanium layer.

6. A detector as defined in claim 2 further characterized in that:

(a) said low-resistance anode layer comprises a wedge-and-strip anode having busbars for reading out charges, in a manner proportional to said image charge; and (b) at least two edges of said anode layer are at right angles to one another.

7. A detector as defined in claim 2 further characterized in that said structured, low-resistance anode layer comprises a Vernier anode.

8. A detector as defined in claim 2 wherein said structured, low-resistance anode layer has a spiral structure.

9. A detector as defined in claim 2 characterized in that said structured, low-resistance anode layer comprises a delay line layer.

10. A detector as defined in claim 2 wherein said structured, low-resistance anode layer comprises a pixel system that is digitally read out by means of a CCD.

11. A detector as defined in claim 6 wherein said low resistance anode layer is applied to a separate plate mechanically adapted to the outer surface of said counter-substrate.

12. A detector as defined in claim 6 further characterized in that said structured anode layer is applied directly to the outer surface of said counter-substrate.

13. A detector as defined in claim 2 wherein the internal resistances of the chargee collecting layer and the capacitively coupled outer anode layer are selected for optimum spatial resolution.

14. A detector as defined in claim 2 further characterized in that:

(a) the outer, low-resistance anode layer includes a sensitive area; and (b) said sensitive area projects over the edges of the vacuum-side charge collecting layer so that image errors are avoided at said edges.

* * * * *